US007422497B1

(12) United States Patent
Wyant et al.

(10) Patent No.: US 7,422,497 B1
(45) Date of Patent: Sep. 9, 2008

(54) HAPTIC NOTIFICATION SYSTEM FOR A MARINE VESSEL

(75) Inventors: John W. Wyant, Fond du Lac, WI (US); Phillip K. Gaynor, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/716,234

(22) Filed: Mar. 9, 2007

(51) Int. Cl.
*B63H 21/21* (2006.01)

(52) U.S. Cl. ..... 440/2; 440/84

(58) Field of Classification Search ..... 440/1, 440/2, 84, 86, 87
See application file for complete search history.

(56) References Cited

U.S. PATENT DOCUMENTS 5,481,261 A * 1/1996 Kanno ..... 440/87
6,091,321 A * 7/2000 Karell ..... 340/425.5
6,116,971 A * 9/2000 Morikami ..... 440/2
6,904,823 B2 6/2005 Levin et al. ..... 74/471 XY
7,040,319 B1 5/2006 Kelly et al. ..... 128/204.22
7,112,107 B1 * 9/2006 Torgerud ..... 440/2
7,126,496 B2 10/2006 Greene ..... 340/946

* cited by examiner

*Primary Examiner*—Lars A Olson
(74) *Attorney, Agent, or Firm*—William D. Lanyi

(57) ABSTRACT

A haptic notification system for a marine vessel is provided which alerts the marine vessel operator and passengers even if those individuals are displaced from the helm position. By changing a sensible characteristic of the vessel, the passengers and operator can be haptically notified that one of them should return to the helm in order to determine the condition about which they were notified.

6 Claims, 2 Drawing Sheets

HAPTIC NOTIFICATION SYSTEM FOR A MARINE VESSEL

BACKGROUND OF THE INVENTION

1. Field of the Invention

The present invention is generally related to an alarm or notification system for a marine vessel and, more particularly, to a system that uses haptic notification to inform the operator of a marine vessel that the operator's attention is required to address an operating condition.

2. Description of the Related Art

It is generally known to those skilled in the art that haptic or tactile techniques can be used to get the attention of a human being and notify that human being of a condition that requires attention.

U.S. Pat. No. 6,904,823, which issued to Levin et al. on Jun. 14, 2005, describes haptic shifting devices. The haptic shift device is intended for use in shift-by-wire systems in vehicles. The haptic shift device includes a shift lever manipulatable by a user. At least one sensor detects a position of the shift lever, and a transmission gear of the vehicle is caused to be changed based on the position of the shift lever. At least one electrically-controlled actuator outputs a force on the shift lever. In some embodiments, the shift lever is movable within a pattern and is blocked from areas outside the boundaries of the pattern.

U.S. Pat. No. 7,040,319, which issued to Kelly et al. on May 9, 2006, describes a method and apparatus for monitoring oxygen partial pressure in air masks. The oxygen partial pressure in the air masks is detected using an electrochemical sensor, the output signal from which is provided to a comparator. The comparator compares the output signal with a preset reference value or range of values representing acceptable oxygen partial pressures. If the output signal is different than the reference value or outside the range of values, the air mask is vibrated by a vibrating motor to alert the user to a potentially hypoxic condition.

U.S. Pat. No. 7,126,496, which issued to Greene on Oct. 24, 2006, describes a tactile cueing system and method for aiding a helicopter pilot in making landings. The system is intended for warning a helicopter pilot of a preselected altitude during a landing maneuver and it includes a collective control arm for control of the aircraft and a tactile warning device operatively connected to the collective control arm. The system includes a radio altimeter for sensing the actual altitude, a computer and keyboard for inputting a preselected height above the ground into the computer memory. A signal generator generates a signal indicative of the actual altitude as the aircraft approaches the ground. Then, when the actual altitude is equal to or less than the preselected altitude the system activates the tactile device. The warning system is also combined with a tactile warning system for avoiding "hot starts" and for avoiding other dangerous conditions.

The patents described above are hereby expressly incorporated by reference in the description of the present invention.

SUMMARY OF THE INVENTION

A method for notifying an operator of a marine vessel, in a preferred embodiment of the present invention, comprises the steps of providing a marine propulsion system configured to exert a thrust on the marine vessel, determining that a condition exists for which the operator should be informed, and haptically notifying the operator of the condition.

In a particularly preferred embodiment of the present invention, the notifying step comprises the step of changing an operating characteristic of the marine propulsion system in a way that can be haptically sensed by the operator. The operating characteristic can be the operating speed of an engine of the marine propulsion system. The changing step, in a preferred embodiment of the present invention, is sensible by all of the passengers on the marine vessel when the passengers are displaced from the helm of the marine vessel. By this, it is meant that passengers who are not present in the immediate vicinity of the helm will also be effectively notified by the haptic signal. In a preferred embodiment of the present invention, the operating characteristic is the velocity of the marine vessel. It can also be the trim condition of the marine vessel. In a preferred embodiment, the changing step comprises the steps of decreasing the operating speed of an engine of the marine propulsion system and subsequently increasing the speed of the engine back to the speed prior to the decreasing being performed. The changing step can comprise the steps of decreasing the operating speed of an engine of the marine propulsion system by at least 300 RPM. However, lesser decreases can also be effective in notifying the operator and passengers of certain small vessels.

In a preferred embodiment of the present invention, it can further comprise the step of determining a velocity of the marine vessel. The changing step therefore can comprise the step of decreasing the operating speed of the engine only if the velocity is above a minimum threshold. The minimum threshold can be a velocity which is sufficient to maintain a planing velocity of the marine vessel after the decreasing step is accomplished. This step can also use the engine speed as an analog of vessel velocity instead of measuring velocity directly. The notifying step can also comprise the step of haptically changing a condition of a component with which the operator is in contact, such as the steering wheel or seat. Alternatively, the floor area around the helm position can be activated to haptically signal the operator or other passengers of the marine vessel.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
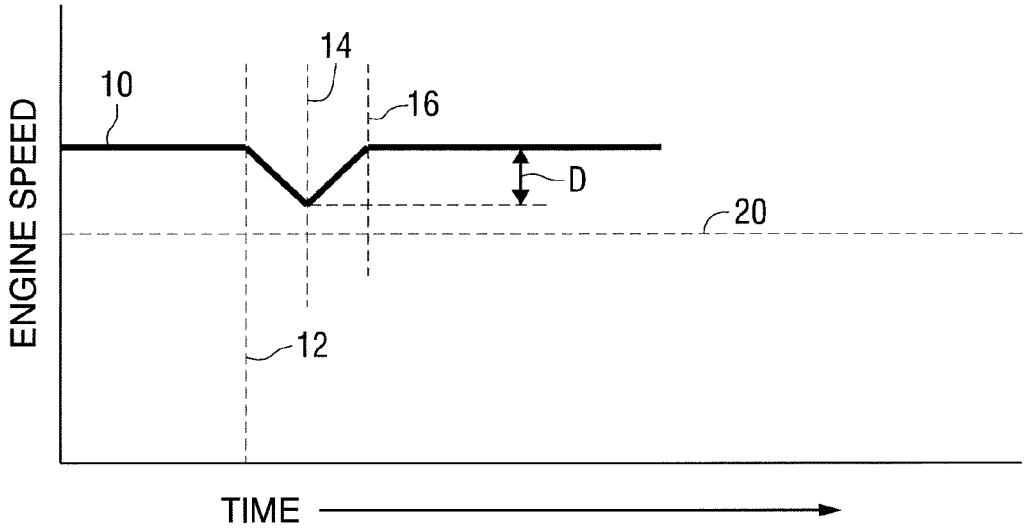
FIG. 1 is a simplified graphical representation of a change in velocity that can be used to haptically notify an operator or passengers of a marine vessel.

Throughout the description of the preferred embodiment of the present invention, like components will be identified by like reference numerals.

The primary function of a preferred embodiment of the present invention is to haptically inform the operator and passengers of a marine vessel that a condition exists which requires attention. It is particularly intended to provide this type of notification to the operator and/or passengers when those individuals are not in the immediate location of the helm of the marine vessel. When the marine vessel is placed in a cruise control mode of operation, it is not uncommon for the passengers and operator to move away from the immediate vicinity of the helm. If all alarm messages and other notifications are either provided visually on a computer screen or audibly in the immediate vicinity of the helm, it is possible that these notifications and alarm conditions can be unobserved or unnoticed by the operator and passengers. Haptic notification that can be sensed at many different locations on the marine vessel can get the attention of the operator and/or passengers even when they are not in the immediate vicinity of the helm.

One form of haptic notification relates to a change that is made in the operating speed of the engine of the marine propulsion system of the marine vessel. FIG. 1 is a simplified graphical representation of an engine speed 10 illustrated as a function of time. The engine speed, typically measured in RPM, can be changed temporarily to get the attention of the operator and passengers on the marine vessel. At the time represented by the dashed line 12 in FIG. 1, the operating speed of the engine is decreased by the amount represented by arrow D. This decrease in operating speed of the engine occurs over a relatively short period of time (e.g. two seconds) until it reaches a minimum operating speed at the point in time identified by dashed line 14. Then, the control system for the marine propulsion system restores the operating speed of the engine until, as represented by dashed line 16, until it is generally equal to the operating speed of the engine prior to the beginning of the notification process at dashed line 12.

With continued reference to FIG. 1, dashed line 20 represents a threshold magnitude for the engine operating speed that is equivalent to an engine speed that will cause the marine vessel to have a velocity sufficient to maintain the vessel in a planing condition. If the engine operating speed is below that threshold 20, the notification procedure illustrated in FIG. 1 could be inhibited in certain embodiments of the present invention. In other words, it is not considered advisable to decrease the engine speed for these purposes if that decrease in speed would cause the marine vessel to come off of plane. This engine speed, represented by dashed line 20, can be determined empirically for the vessel and preselected as a minimum engine speed under which the present invention can be applied. The operator and passengers on the marine vessel will haptically sense a momentary decrease in velocity of the marine vessel and restoration of that velocity between the times represented by dashed lines 12 and 16 in FIG. 1. It has been determined that in many types of marine vessels, a decrease D of approximately 300 RPM is sufficient to get the attention of the operator and passengers even if those individuals are displaced from the helm location. In response, the operator of the marine vessel can return to the helm in order to determine the specific alarm condition or operating characteristic that requires attention. By haptically notifying the operator and passengers regardless of the location on the marine vessel where those individuals happen to be, quick attention can be drawn to the alarm condition and corrective or reactive response can be quickly obtained.

Figure 2:
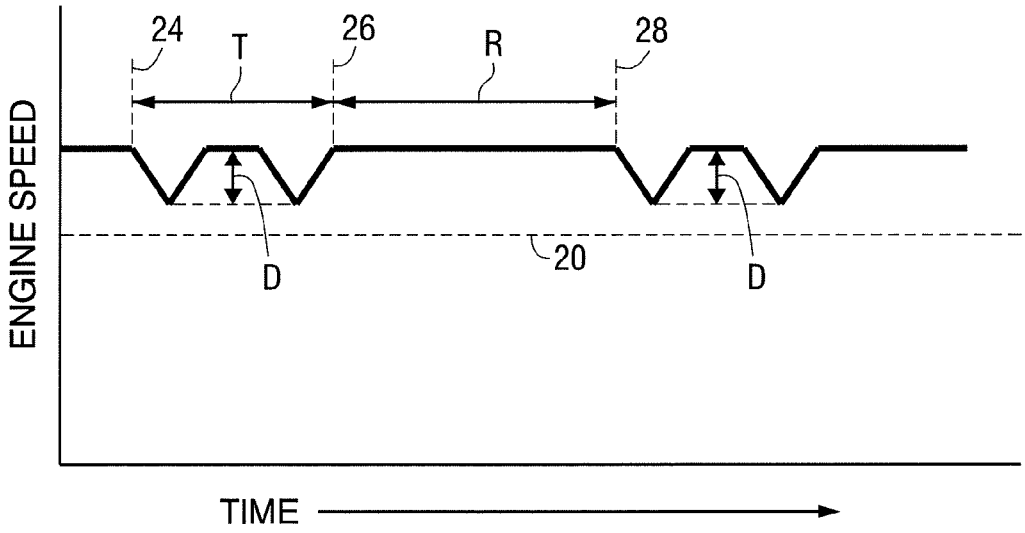
FIG. 2 is a graphical representation of an alternative embodiment which uses two velocity changes and which repeats those changes periodically until a response is recognized from the operator of the marine vessel.

FIG. 2 shows the use of two sequential decreases and subsequent restorations of engine speed between dashed lines 24 and 26. Again, the decrease in speed is represented by arrow D. In certain embodiments of the present invention, the time period T between dashed lines 24 and 26 can be approximately five to ten seconds. In certain conditions, the two sequential signals between dashed lines 24 and 26 can more efficiently get the attention of the operator and passengers on the marine vessel. Although a single decrease and restoration, as illustrated in FIG. 1, is sufficient in many instances, a dual notification procedure, as shown between dashed lines 24 and 26 in FIG. 2, can be more effective. In addition, after a delay, such as that represented between dashed lines 26 and 28 in FIG. 2, the notification procedure can be repeated as shown in FIG. 2. This process can be continuously repeated until the operator returns to the helm and addresses the condition requiring attention.

The condition for which the haptic notification is performed can vary from a serious situation (e.g. engine over temperature conditions, low oil pressure conditions, low fuel in the fuel tank, an obstruction in the path of the marine vessel) or a less serious purpose for notification (e.g. the approach of a way point, a preset time alarm clock notification). In most embodiments of the present invention, it is anticipated that a visual message would be provided on a computer monitor screen in combination with the haptic notification. When the operator returns to the helm, the visual description of the operating condition requiring attention can be read and addressed. It is also anticipated that the haptic notification system of the present invention can be used in combination with an audible alarm system that may only be audible within a limited range of the helm location.

Figure 3:
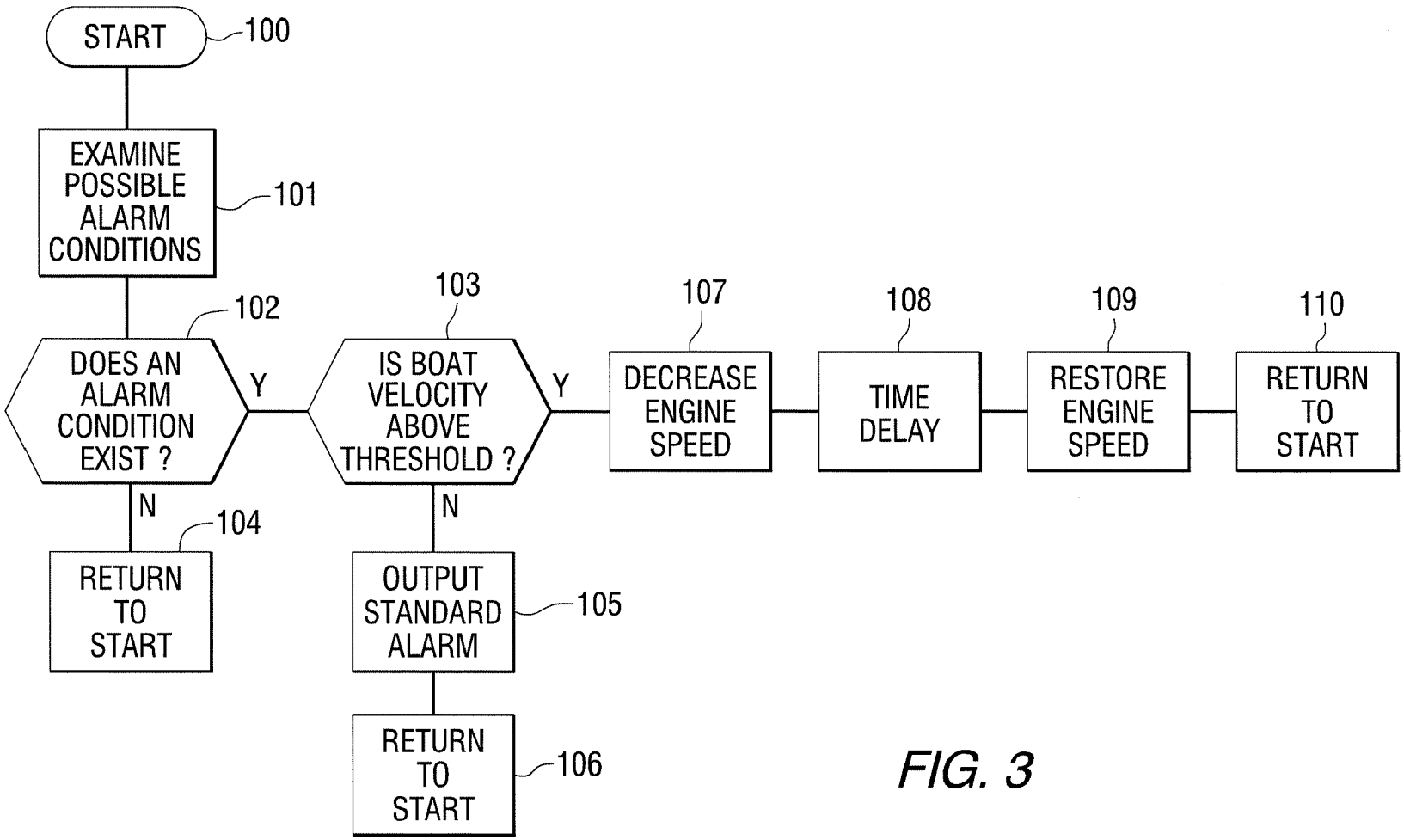
FIG. 3 is a simplified exemplary flowchart of one embodiment of the present invention.

FIG. 3 is a simplified flowchart that shows one embodiment of the present invention and how it might be executed. Beginning at the start position 100, a microprocessor associated with the marine propulsion system or the helm control system reviews various conditions (e.g. oil pressure, temperature, cooling water flow, fuel level in the fuel tank) and determines whether the operator of the marine vessel should be notified that some characteristic requires attention from the operator. This examination is described in functional block 101 in FIG. 3. If any of the possible alarm conditions requires notification of the operator of the marine vessel, as determined at functional block 102, the microprocessor determines that some sort of alarm should be provided in order to get the attention of the operator. The program then determines whether or not the boat velocity is above a threshold magnitude, at functional block 103, in order to determine if the velocity can be decreased as described above in conjunction with FIGS. 1 and 2 without causing the marine vessel to move off of plane condition. This can be done by measuring velocity directly or by measuring engine speed and indirectly determining the sufficiency of the vessel velocity.

With continued reference to FIG. 3, it should be understood that if an alarm condition does not exist, as determined by functional block 102, the program goes to functional block 104 and returns to the starting position 100. Furthermore, if the boat velocity is not above the threshold 20 described above, a standard alarm is provided at functional block 105 and then the program returns to the start position as indicated at functional block 106. If, however, the boat is at a sufficient velocity to allow the haptic notification described above in conjunction with FIGS. 1 and 2, the engine speed is decreased at functional block 107, a time delay is executed at functional block 108 and the engine speed is restored at functional block 109. These conform to the description above in conjunction with the decrease in engine speed between dashed lines 12 and 14 in FIG. 1 and the restoration of engine speed between dashed lines 14 and 16. The time delay at functional block 108 is, essentially, equal to zero in FIG. 1, but it should be understood that a brief delay may be determined to be beneficial in getting the attention of the boat operator and passengers. After restoring the engine speed at functional block 109, the program returns to the start position as indicated by functional block 110.

It should be understood that the condition requiring notification need not be a conventional alarm condition (e.g. low oil pressure, increasing engine temperature). In addition to these types of alarm conditions, it can also be beneficial if the passengers of the marine vessel can be notified haptically that the vessel is about to change course or slow down. If the marine vessel is provided with an auto-pilot capability, where it can follow a predetermined series of way points, it may be beneficial if the passengers on the marine vessel can be notified prior to each course change so that the passengers are not surprised by a turning of the marine vessel at the way points. The reasons and purposes of the notifications should not be considered limiting to the present invention. Instead, the haptic notification provided by the present invention should be considered as a substitute or supplement to conventional notification methods (e.g. horns, buzzers, lights, messages on computer screens). By providing a haptic notification system that does not require the operator's presence at the helm position, the operator and passengers can move about the marine vessel with the assurance that they will be notified when a condition requires the attention of the operator at the helm position.

Although the present invention has been described in particular detail and illustrated to show a preferred embodiment, it should be understood that alternative embodiments are also within its scope.

We claim:

1. A method for notifying an operator of a marine vessel, comprising the steps of:

providing a marine propulsion system configured to exert a thrust on said marine vessel;

determining that a condition exists for which said operator should be informed, said condition being a nonfeedback condition, namely a condition occurring independently of and not in response to an act of said operator; and haptically notifying said operator of said condition;

wherein:

said notifying step comprises the step of changing an operating characteristic of said marine propulsion system in a way that can be haptically sensed by said operator.

2. The method of claim 1, wherein:

said operating characteristic is the operating speed of an engine of said marine propulsion system.

3. The method of claim 1, wherein:

said operating characteristic is the velocity of said marine vessel.

4. The method of claim 1, wherein:

said operating characteristic is the trim condition of said marine vessel.

5. A method for notifying an operator of a marine vessel, comprising the steps of:

providing a marine propulsion system configured to exert a thrust on said marine vessel;

determining that a condition exists for which said operator should be informed, namely a condition occurring independently of and not in response to an act of said operator; and haptically notifying said operator of said condition;

wherein:

said notifying step comprises the step of changing an operating characteristic of said marine propulsion system in a way that can be haptically sensed by said operator; and said changing step comprises the steps of decreasing the operating speed of an engine of said marine propulsion system and subsequently increasing the speed of said engine.

6. A method for notifying an operator of a marine vessel, comprising the steps of:

providing a marine propulsion system configured to exert a thrust on said marine vessel;

determining that a condition exists for which said operator should be informed, namely a condition occurring independently of and not in response to an act of said operator; and haptically notifying said operator of said condition;

wherein said notifying step comprises the step of changing an operating characteristic of said marine propulsion system in a way that can be haptically sensed by said operator;

and further comprising determining a velocity of said marine vessel, said changing step comprising the step of decreasing the operating speed of an engine if said velocity is above a minimum threshold;

wherein said minimum threshold is a velocity which is sufficient to maintain a planing velocity of said marine vessel after said decreasing step is accomplished.

* * * * *